United States Patent [19]

Bellaff

[11] 4,194,488

[45] Mar. 25, 1980

[54] HOME HEATING SYSTEM

[75] Inventor: Leslie Bellaff, River Edge, N.J.

[73] Assignee: William W. Weaver, Va.

[21] Appl. No.: 946,188

[22] Filed: Sep. 27, 1978

[51] Int. Cl.[2] ..... F24H 3/00; F24B 7/00

[52] U.S. Cl. ..... 126/112; 110/160; 110/188; 126/99 A; 165/DIG. 2; 237/55; 432/72

[58] Field of Search ..... 126/105 R, 112, 99 A, 126/109, 77, 146, 15 R, 15 A, 312, 307 A; 110/188, 189, 190, 297, 160; 165/DIG. 2; 237/53, 55; 432/72

[56] References Cited

U.S. PATENT DOCUMENTS

| | | | |
|---|---|---|---|
| 71,244 | 11/1867 | Thatcher | 126/112 |
| 455,542 | 7/1891 | Emerson | 126/112 |
| 519,325 | 5/1894 | Davids | 110/160 |
| 533,287 | 1/1895 | French | 110/160 |
| 767,636 | 8/1904 | Dietz | 126/112 |
| 1,232,769 | 7/1917 | Carr | 126/112 |
| 3,119,604 | 1/1964 | Biber et al. | 110/160 |
| 3,913,501 | 10/1975 | Dahar | 110/190 |
| 4,033,269 | 7/1977 | Little et al. | 110/160 |
| 4,147,303 | 4/1979 | Talucci | 165/DIG. 2 |

*Primary Examiner*—James C. Yeung
*Assistant Examiner*—Daniel J. O'Connor
*Attorney, Agent, or Firm*—McGlew and Tuttle

[57] ABSTRACT

In a home heating system having a furnace with a combustion chamber for burning fuel and creating heat, and a chimney with a draft therein, an improvement comprising, an exhaust flue connected between the combustion chamber and the chimney for venting heated exhaust products from the furnace, a heat reclaimer connected into the exhaust flue between the combustion chamber and the chimney for reclaiming heat from the heated exhaust product, and an outside air line for supplying air from the outside of the house to the combustion chamber. A first flue portion of the exhaust flue is connected between the combustion chamber and the heat reclaimer, and a second insulated flue portion of the exhaust flue is connected between the heat reclaimer and the chimney. An outside air by-pass or balancing line is connected between the outside air line and the chimney for satisfying the chimney suction at flame-out. A flow sensing and regulating device may be connected into the outside air line for regulating the flow or air so that outside air is supplied to the furnace only when fuel is burned therein.

10 Claims, 4 Drawing Figures

HOME HEATING SYSTEM

BACKGROUND OF THE INVENTION

1. Field of the Invention

The present invention relates in general to more efficient house heating systems, and in particular to a new and useful home heating system which utilizes an outside combustion air source as well as a heat reclaimer for reclaiming heat from the exhaust gases of a furnace to provide a coherent heating system with increased fuel economy.

2. Description of the Prior Art

Heretofor a wide variety of heating systems are known which utilize furnaces having combustion chambers for burning a fuel such as natural gas, propane, or oil by consuming oxygen-containing air to produce heat. The heat is then transferred to a heating medium such as air or water, which is circulated to other portions of the house.

In burning a fuel-air mixture, heated exhaust fumes and other by-products are produced, which in general are vented to the exterior of the structure being heated. A wide variety of devices are known for reclaiming heat in this exhaust product, and thus better utilizing the heat produced by the burned fuel.

In standard home heating furnaces, combustion air which is utilized to provide oxygen in the burning of fuel is usually supplied in a haphazard manner from the general open spaces of the dwelling. A vacuum is created in the combustion chamber of the furnace, and air is drawn into the furnace to burn the fuel supplied therein. As this air is drawn from the dwelling, it must be replaced from outside the house through leaks, open windows, or the like. As the price of heating fuels increases and the availability of these fuels decreases, it has recently become the custom to heavily insulate a dwelling and also to reduce or eliminate all air leaks which tend to cause heat loss. In extreme cases, there arises a danger that insufficient combustion air will be provided to the furnace, thereby producing partial combustion of the fuel and possibly even producing dangerous by-products such as carbon moxide, which may be sucked back into the dwelling which is at a partial vacuum.

Proposals have been made for providing a specialized combustion air line to the combustion chamber of a furnace from the exterior of a dwelling. Such a combustion air line would provide cool outside air directly to the furnace and thereby eliminate the need for tapping the generally available warm dwelling air for this purpose. The provision of such a combustion air line also eliminates the dangers of incomplete combustion, and permits the total sealing of a dwelling against drafts and other unwanted air flows.

Other examples of previous attempts at increasing the efficiency of heating units are disclosed in the following patents:

U.S. Pat. No. 3,198,190 to Gordon,
U.S. Pat. No. 2,962,218 to Dibert,
U.S. Pat. No. 2,768,675 to Conn,
U.S. Pat. No. 2,537,082 to Palmer,
U.S. Pat. No. 2,508,885 to MacKay,
U.S. Pat. No. 1,979,462 to Garnder et al, and
Article, "Outside Venting" by Evan Powell, *Popular Science*, October, 1973.

SUMMARY OF THE INVENTION

The present invention comprises a home heating system which utilizes a heat reclaimer for tapping the heat in exhaust gases from a furnace and a line for providing cold outside air to the combustion chamber of the furnace for the burning of fuel therein. The utilization of cold outside air increases the efficiency of combustion in that cold air is denser than warm air and thereby provides an increased concentration of oxygen over that of warmer inside air, which would normally be used in the combustion chamber of the furnace. The inventive system utilizes a standard chimney which has a draft established therein. A chimney draft, as is known, is established by the differential in air temperature between the bottom and the top of the chimney. The warmer, denser air supplied to the bottom of a chimney tends to rise, thereby establishing a draft or suction which is advantageously used to vent exhaust gases from the furnace. It has been found that even when the exhaust gas temperatures are reduced to room temperature by the heat reclaimer, sufficient pressure differential is still available to the base of the chimney for maintaining a usable draft.

The heat reclaimer or heat exchanger used in accordance with the invention is connected in the exhaust flue which is normally provided between the exhaust outlet of a furnace and the chimney. The portion of the exhaust flue which is connected between the heat reclaimer itself and the chimney is insulated from its surroundings so that there is no temperature change in the exhaust gases in this portion of the exhaust flue. The reason for providing such insulation is that any reduction in temperature of exhaust gases below an ambient dew point will cause condensation of water vapor and thus a water problem. This liquid becomes of a corrosive nature in that it combines with other exhaust products in the exhaust gases and forms corrosive components. Another reason for providing such insulation is to prevent cold balancing air from carrying heat up the chimney, thus reducing the heat reclaimer's potential energy level and efficiency. A suitably chosen material for the heat reclaimer can be provided which is noncorrosive in the presence of these corrosive products. For example, when the fuel to be burned is natural gas or propane, the heat reclaimer should be made of copper construction or be copper lined. When the fuel to be used in the furnace is oil, a stainless steel heat reclaimer or heat reclaimer lining is utilized.

The heat includes an exhaust passage through which the exhaust fumes from the furnace travel and a cool air passage through which cool air supplied from the building passes. The two passages cross each other so that heat may be transferred from the hot exhaust gases to the cooler house air. The exhaust gas passage communicates with a drain for draining the condensed liquid, which is isolated from the cool air passage.

The combustion chamber of the furnace is connected to an outside air line which communicates with the outside atmosphere to supply fresh air to the combustion chamber for the burning of fuel. A return line or balancing air line is connected between the outside air line and the chimney to provide a passage for outside air and satisfy chimney suction when no air is being drawn into the furnace for burning purposes. The provision of this balancing line prevents a flow of cold air into the house when the furnace burner is not activated, which would normally cause a cooling of the furnace and the robbing of heat. A flow regulator and control means is associated with the outside or balancing air line so that when the burner is off in the furnace, a minimum of cold air is drawn into the furnace through the outside air line. The regulator is open to permit maximum bypass or balancing air during flame-out. The regulator is closed to permit a good supply of combustion air during flame-on periods. A failure of this regulator would only reduce the advantage it gives in efficiency. The unit would operate satisfactorily even with this device malfunctioning. A feather may also be provided in the combustion or outside air line with a plate glass for external viewing. This feather provides a visual indication of the air flow and should indicate minimal air flow when the furnace is off. This feather gage is used to adjust a fixed baffle to limit excess air during flame-on periods and reduce cold and leakage during flame-on.

In one embodiment of the invention, both the exhaust flue from the furnace and the bypass or balancing air line from the outside air line enter the chimney through a single hole. This enables the installation of the inventive home heating system in existing heating structures without requiring additional masonry work in the area of the chimney. A requirement for this structure is, however, that the return line be insulated from the flue until the flue and return air line are in the chimney itself. Without such insulation, the colder return air line would cause a reduction in temperature in the gases of the flue, and result in additional condensation as heretofore explained. Once the cold air from the return line and the warmer exhaust air mingle with each other in the chimney, condensation will occur and, for this purpose a drain is provided at the bottom of the chimney.

It should be noted that a fixed baffle or suitable sizing for the outside air line and return air line can be selected which will provide for the proper and desired air flows. This is true since the suction established in the combustion chamber of the furnace is substantially constant when fuel is to be burned and the draft in the chimney is always available to vent gases therefrom. As an alternative system for controlling the flow of outside air, an electric system can be provided which includes a sensor in the outside or combustion air line which is connected to a valve or flow regulating device in the return line. The sensor is connected to the burner of the furnace to be utilized, and is energized only when the furnace is deactivated. Since a zero flow rate is desired in the combustion air line when the furnace is in its off condition, the sensor, sensing any flow will control the flow regulator to permit a greater flow in the return line and thus reduce the air flow in the combustion air line to zero. Alternatively to this structure, a pulley and cable system may be provided for manually adjusting a baffle in the combustion air line to stop the flow of air therein.

Accordingly, an object of the present invention is to provide an improvement in home heating systems having a furnace with a combustion chamber for burning fuel to create heat and a chimney with a draft therein, comprising, an exhaust flue connected between the combustion chamber and the chimney for venting heated exhaust products from the furnace, a heat reclaimer connected into said exhaust flue between the combustion chamber and the chimney for reclaiming heat from the heated exhaust product, a first uninsulated flue portion of said exhaust flue connected between the combustion chamber and said heat reclaimer, a second insulated flue portion of said exhaust flue connected between said heat reclaimer and the chimney, a combustion air line connected to the combustion chamber, an outside air line connected between the outside of the house and the combustion air line to supply outside air to the combustion chamber, an outside air return line connected between the junction of said combustion air and outside air line and the chimney, and a flow sensing and regulating means associated with the combustion air and return lines for providing a flow of outside air to the combustion chamber when fuel is burned therein and for providing a flow of air in said return line with no flow of air in said combustion air line when fuel is not burned in the combustion chamber, said heat reclaimer comprising a housing, and exhaust passage through said housing for the passage of exhaust from said flue, a cool air passage in said housing, a cool air inlet connected to said housing for inletting cool air from the house, a warm air outlet line connected to said housing for warm air from the heat reclaimer and a liquid drain at the base of said housing communicating with the exhaust passage for draining condensed liquids therefrom.

Another object of the present invention is to provide a home heating system which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
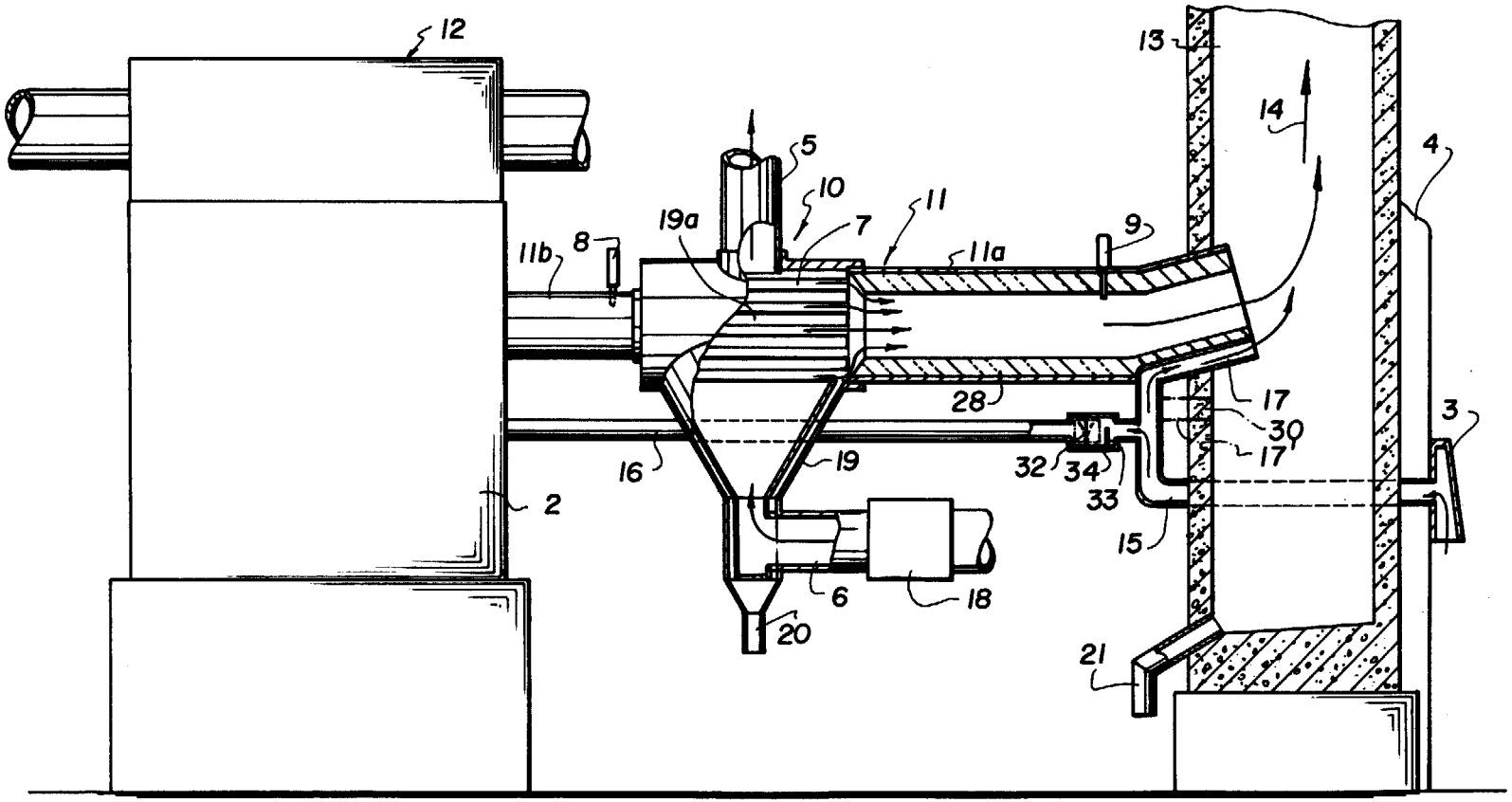
FIG. 1 is a side elevational cross sectional view of the home heating system in accordance with the invention.

Referring to FIG. 1 a device for efficiently heating a house is disclosed having a heat reclaimer or heat exchanger generally designated 10, connected into the exhaust flue 11 of a furnace 12. Exhaust flue 11 is connected to a chimney 13 which has a substantially constant draft therein in the direction of arrow 14. An outside air line 15 extends through an outside wall 4 and communicates with the atmosphere outside the house to bring fresh cool air to the combustion chamber 2 of the furnace 12 through a combustion air line 16. Line 15 is shown extending behind chimney 13, and line 16 is shown extending behind heat exchanger 10. A balancing line 17 is provided in the outside air line between the junction of the combustion air line 16 and the chimney 13. Outside air line 15 is covered by a line cover 3 to protect it from the weather. A cool air duct 6 is connected to a heat reclaimer housing 19 supplying it with cool house air from, for example, the basement of a house. A blower or fan 18 may be connected to duct 6 and provided for blowing the cool air into heat exchanger or heat reclaimer 10 to reclaim heat from the hot gases coming from the furnace 12 through the exhaust flue 11 and utilize it for heating the house. Air thus warmed is fed through duct 5 to the house. A drain 20 is provided at the bottom of the heat reclaimer and a drain 21 is provided at the bottom of the chimney 13 to provide for the drainage of condensed liquid coming out of the exhaust gases when they experience a temperature reduction. For this purpose exhaust passages 7 communicate with drain 20. The material of the heat exchanger 10 is preferably copper or a non-corrosive material when the fuel to be used in furnace 12 is natural gas, so that the heat exchanger does not break down and corrode due to the condensed liquid and byproducts from the exhaust gases of the furnace. When the fuel to be used in furnace 12 is oil, a stainless steel heat reclaimer 10 should be used.

In operation the draft 14 in the chimney 13 is normally utilized to vent exhaust gases from the furnace 12 after they are used in the combustion process. Air coming from the general open spaces of the house is channeled into the furnace for providing sufficient oxygen to burn the fuel therein. This combustion air is provided through leaks or other unavoidable intakes of cold air from the exterior of the house. In the inventive device air is channeled from the outside through the outside air line 15 and the combustion air line 16 into the combustion chamber 2 of the furnace 12. When the flame begins in the furnace 12 a vacuum is established thus drawing air through the combustion air line 16 and from the outside air line 15. The exhaust gases coming from the furnace 12 are then channeled through the exhaust flue 11 and past the heat exchanger 10 through copper of stainless tubes or passages 7 therein. Cool air such as from the basement or cool area of the house is blown through the fan 18 or drawn by a temperature differential in heat reclaimer 10, into the heat exchanger 10 through cool air passage **19*a* and thereafter to the house in a warm state. Due to the non-corrosiveness of the heat exchanger 10 and the drain 20 a large heat differential may be established between the air coming directly from the furnace at a first flue 11*b* and the air being vented to the chimney at second flue 11*a*. This differential can be observed at thermometers 8 and 9. Such an efficient reduction of exhaust gas temperature is not feasible in other systems in that the extreme reduction of the temperature often causes condensation of liquids and an eventual corrosion of the flue and heat exchanger. An only moderately warm exhaust gas is supplied to the chimney 13** in accordance with the invention.

When the flame in the furnace 12 is shut down the vacuum caused by the flame dissipates, thus stopping the flow of air in the combustion air line 16. The outside air then travels through the return line 17 and into the chimney 13 through the action of the draft 14 which acts on the return line 17 in a similar fashion as its action on the exhaust flue 11. The admixture of the cool air coming from the line 17 and the warmer exhaust air coming from the flue 11 causes a secondary condensation of fluid which is vented from the chimney 13 to the chimney drain line 21. The relationships between the sizes or effective cross-section in the pipes must be chosen so that the ignition of the flame in the furnace 12 draws air through the combustion air line 16 and the extinguishing of that flame allows no air to flow through the combustion air line permitting all the air to flow through the return line 17. A preferable relationship for the cross-sections of these respective lines has been found to be approximately 1:2:4 for the return line 17; the combustion air line 16; and the exhaust flue 11 respectively.

A flow sensor and regulator means is provided and associated with the combustion air line and return or balancing air line. In FIG. 1, the flow sensor and regulator means take the form of a baffle and feather box 34 which is connected into the combustion air lines 16. Box 34 includes an upstanding feather 32 which can be viewed through a window shown in phantom line. Also included in box 34 is a fixed baffle 33 which can be adjusted once at the beginning of operation of the system and left in this position substantially throughout the life of the system. Feather 32 is provided to sense the flow of gases within line 16 when the furnace 12 is not firing. If any flow is sensed in line 16 at this time, the feather will bend for example, to the left, and indicate a flow of cold air into the furnace. The baffle then is positioned so that no flow is sensed in line 16 and all the outside air from line 15 enters return line 17 and the chimney 13. This flow of air through line 15 and 17 is maintained by draft 14 which is present in the chimney 13.

Figure 2:
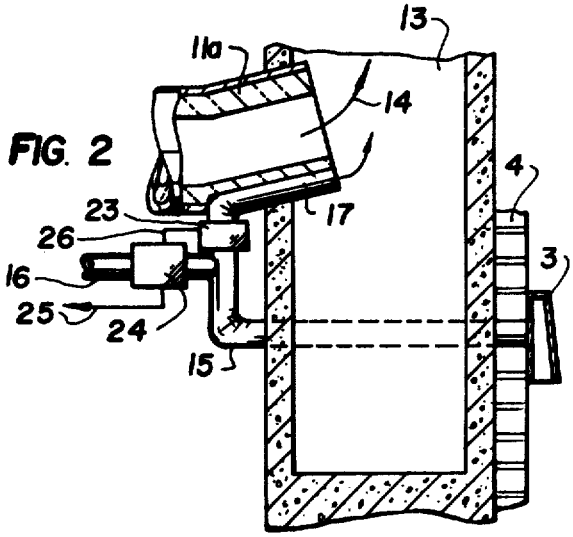
FIG. 2 is a schematic detail of another embodiment for the flow sensor and regulator in accordance with the invention.

To better adjust the various flows, an additional flow control means 23 such as an electric valve can be connected into the balancing line 17 as seen in FIG. 2. Valve 23 is controlled by a flow sensor 24. Like elements of FIG. 2 are similarly numbered. The use of sensor 24 with valve 23 allows for a higher baffle 34. The sensor 24 can in turn be connected into the furnace 12 through a line 25 so that when the flame in the furnace is shut off the sensor 24 senses whether any air flows in or out through the combustion air line 16. Upon sensing the flow of air in one direction or the other in the combustion air line, the sensor will send a signal through a line 26 to the control means 23 to open or close a baffle in the return line 17 until no flow is sensed within the combustion air line 16.

Insulation 28 is provided on the exhaust flue **11*a* and between the return line 17 and the exhaust line 11*a* so that no heat is conducted from the exhaust flue 11 which might migrate back to the heat exchanger 10 and disadvantageously cool the house. This insulation also prevents or reduces any additional condensation in flue 11*a* due to further heat loss. Return line 17 extends through the same hole in the chimney 13 provided for the exhaust flue 11*a*. Alternatively, a second hole 30 may be provided for the return line 17' shown in phantom. This alternative structure also allows a thermal isolation between the return line 17 and the exhaust flue 11*a***.

Figure 3:
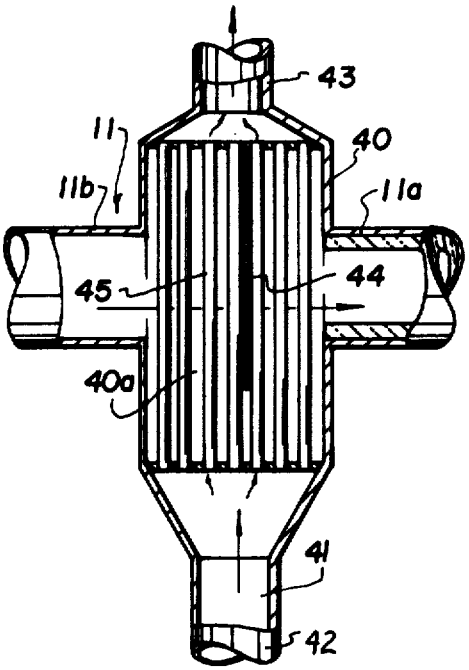
FIG. 3 is a side cross-sectional view of an alternate embodiment for the heat reclaimer.

Referring now to FIG. 3, an alternate form for the heat reclaimer 10 is shown having a housing 40 which is connected between the uninsulated flue **11*b* and the insulated flue 11*a*. Housing 40 defines an exhaust passage 40*a* for the exhaust fumes in flue 11, which communicates with a drain 41 for the condensed liquids. A heatable medium inlet 42 is provided for the inlet of cool medium, such as cool house air or water into the heat reclaimer in FIG. 3. A medium outlet 43 is provided for outletting such fluid. A plurality of tubes 45 connect the inlet 41 with the outlet 43, and the baffle 44 is positioned across a portion of the exhaust passage 40*a* to block some of the exhaust flow and prevent a backflow of cool air from the insulated exhaust line 11*a*** into the heat reclaimer or furnace. This baffle extends ¾ of the way down from the top of the housing.

Figure 4:
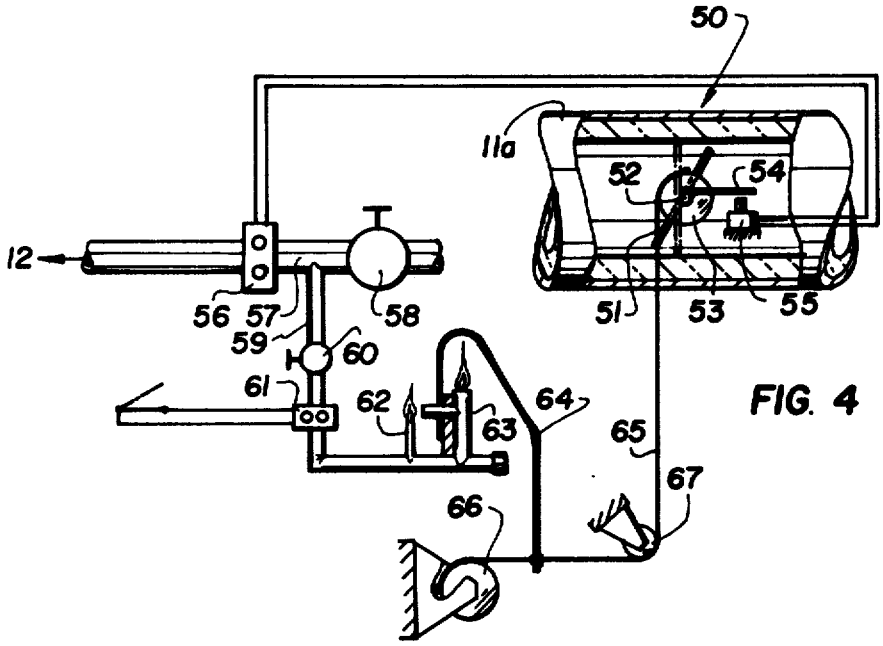
FIG. 4 is a schematic representation of an exhaust flue damper control in accordance with a further embodiment of the invention.

Referring now to FIG. 4, an automatic damper and draft control is shown schematically. The automatic damper 50 includes a damper plate 51 which is pivotally mounted in the exhaust flue 11. Damper plate 1 is based through, for example, spring 52 to remain in a closed position preventing the flow of gases in the flue 11 and thereby preventing cold air from flowing through and picking up furnace heat during flame out periods. Damper plate 51 is connected to a pulley 53 and a limit switch actuator arm 54. A limit switch 55 is provided which is electrically connected to a solenoid 56 for providing gas to the heater 12 through a main gas line 57. Main gas line 57 is provided with a pressure regulator 58 of conventional design. A supplemental gas line 59 is connected to main gas line 57 and supplies gas through a needle valve 60 and a solenid 61 to a pilot 62 and a secondary burner 63. On-off solenoid 61 can be actuated to ignite burner 63. A bimetal member 64 is provided over the secondary burner 63 and expands when burner 63 is ignited to move cable 65 to the right as seen in FIG. 4. Cable 65 may be made of nylon fishing line for example and is wrapped around pulleys 66, 67, 68 and 53. The expansion of bimetal 64 rotates damper plate 51 to open flue 11 and also to actuate limit switch 55. Activation of limit switch 55 opens the main solenoid 56 which ignites the burner of furnace 12. The provision of the damper control in combination with the structure of FIG. 1 is a redundant and back-up method of preventing cold air flow through the furnace during flame-out periods. A small notch in damper plate 51 can be provided for allowing for the pilot light exhaust flow during main flame-out periods.

The device provides for a highly efficient heating system that is finely tuned to provide the proper amount of combustion air to the furnace without relying on leaks or other air flows within the house which should be avoided and for reclaiming as much heat as possible from the exhaust gases vented out of the furnace and simultaneously avoiding the problems of condensation which are inherent in such a heat reclamation device.

It should be noted that this automatic damper is reliable and safe, that is, the main flame cannot light until the damper is opened. Due to the fact that this damper is mechanically operated, the damper plate 51 will close after the bimetal strip has cooled sufficiently. This built-in lag allows for sufficient purging of the combustion products from the furnace without the use of time-delay mechanisms. On the other hand, the main flame cannot ignite until the damper plate 51 is fully opened and the limit switch is closed.

While specific embodiments of the invention have been shown and described in detail to illustrate the application of the principles of the invention, it will be understood that the invention may be embodied otherwise without departing from such principles.

What is claimed is:

1. In a house heating system having a furnace with a combustion chamber for burning fuel and creating heat, a chimney with a draft therein, an improvement comprising: an exhaust flue connected between the combustion chamber and the chimney for venting heated exhaust products from the furnace; a heat reclaimer connected into said exhaust flue between the combustion chamber and the chimney for reclaiming heat from the heated exhaust product; a first uninsulated flue portion of said exhaust flue connected between the combustion chamber and said heat reclaimer; a second insulated flue portion of said exhaust flue connected between said heat reclaimer and the chimney; a combustion air line connected to the combustion chamber; an outside air line connected between the outside of the house and said combustion air line to supply outside air to the combustion chamber; an outside air return line connected between the junction of said combustion air and outside air line, and the chimney; and a flow sensing and regulating means associated with said combustion air and balancing air lines for providing a flow of outside air to the combustion chamber when fuel is burned therein and for providing a flow of air in said balancing air line with substantially no air flow in said combustion air line when fuel is not burned within the combustion chamber; said heat reclaimer comprising a housing, an exhaust passage through said housing for the passage of exhaust from said exhaust flue, a cool medium passage in said housing, a cool medium inlet line connected to said housing for inletting cool medium from the house, a warm medium outlet line connected to said housing for warm medium coming from said heat reclaimer, and a liquid drain at the bottom of said housing communicating with said exhaust passage for draining condensed liquids from the exhaust passage.

2. The improvement of claim 1, further including a drain at the base of the chimney for draining condensed fluids condensing out of the exhaust gases in the chimney when the exhaust gases from said exhaust flue mingle with outside air coming from said balancing air line.

3. An improvement according to claim 1, wherein said flow sensing and regulating means comprises a fixed baffle mounted in said combustion air line and extending therein to block a portion of the flow of outside air in said combustion air line, and a feather gauge extending in said combustion air line between the combustion chamber and said baffle for sensing air flow in said combustion air line, said baffle being fixed at a position so that air is drawn through said combustion air line when fuel is burned in the furnace and no air flows in said combustion air line when no fuel is burned in the furnace.

4. An improvement according to claim 1, wherein said flow sensing and regulating means comprises a flow control valve in said return line for regulating the flow of air therein, a flow sensor in said combustion air line for sensing the presence of flow in said combustion air line, said flow sensor connected to the furnace and to said flow control valve for opening the flow control valve to permit additional flow in said balancing air line when no fuel is burned in the furnace until no air flow is sensed in said combustion air line.

5. An improvement according to claim 1, wherein said heat reclaimer is lined with copper and the fuel burned in the furnace is natural gas.

6. An improvement according to claim 1, wherein said heat reclaimer is lined with stainless steel and the fuel burned in the furnace is fuel oil.

7. An improvement according to claim 1, further including a damper plate pivotally mounted in said insulated flue portion and pivotable from a closed position to prevent the flow of gases in said flue portion to an open position to permit the flow of gases in said flue portion, biasing means connected between said damper plate and flue portion for biasing said damper plate into its closed position, an actuator arm connected to said damper plate, a limit switch associated with said actuator arm to be engaged when said damper is in its open position, the furnace including a main gas line, a main solenoid in said main gas line connected to said limit switch, a supplementary gas line connected to said main gas line upstream of said limit switch, an on-off solenoid in said supplementary gas line, a pilot connected to said supplementary gas line and a secondary burner connected to said supplementary gas line, for being ignited by said pilot, pulley and cable means connected to said damper plate for pivoting said damper plate from its closed position to its open position, a bimetal element connected to said pulley and cable means and adjacent said secondary burner for expanding when said secondary burner is ignited by the actuation of said on-off solenoid to move said pulley and cable means and rotate said damper plate from its closed to its open position.

8. An improvement according to claim 1, wherein said exhaust passage in said heat reclaimer further includes a baffle for resisting the flow the exhaust products through said heat reclaimer, said cool medium passage comprising a plurality of vertical tubes connected between said cool medium inlet and said warm medium outlet.

9. An improvement according to claim 1, wherein said second insulated flue portion and said return line extend through a single hole in the chimney, insulation being disposed between said insulated flue portion and said return line to thermally isolate said return line from said insulated flue portion until gases from each enter the chimney.

10. An improvement according to claim 1, wherein the cool medium from the house is air and said cool medium inlet is an air inlet extending into the bottom of said heat reclaimer housing, a blower connected to said inlet for blowing cool air into said heat reclaimer.

* * * * *